US009284752B2

(12) United States Patent
Zabala Zabaleta

(10) Patent No.: US 9,284,752 B2
(45) Date of Patent: Mar. 15, 2016

(54) ANTI-OVERTURN LOCKING SYSTEM FOR FURNITURE DRAWERS, WITH ELECTRONIC BLOCKING MODULE

(71) Applicant: OJMAR, S.A., Elgoibar (Gipuzkoza) (ES)

(72) Inventor: Jon Zabala Zabaleta, Elgoibar (ES)

(73) Assignee: OJMAR, S. A., Elgoibar (Gipuzkoa) (ES)

( * ) Notice: Subject to any disclaimer, the term of this patent is extended or adjusted under 35 U.S.C. 154(b) by 235 days.

(21) Appl. No.: 14/084,171

(22) Filed: Nov. 19, 2013

(65) Prior Publication Data

US 2014/0225488 A1 Aug. 14, 2014

(30) Foreign Application Priority Data

Feb. 13, 2013 (ES) ..... 201330189

(51) Int. Cl.
*E05B 15/02* (2006.01)
*E05B 65/46* (2006.01)
*E05B 47/00* (2006.01)

(52) U.S. Cl.
CPC ..... *E05B 65/463* (2013.01); *E05B 47/0012* (2013.01); *E05B 65/462* (2013.01); *E05B 2047/0024* (2013.01)

(58) Field of Classification Search
CPC ..... Y10T 292/1021; Y10T 292/699; Y10T 70/7124; Y10T 292/1028; E05B 2047/0073; E05B 65/463; A47B 88/04
USPC ..... 292/341.16, 144
See application file for complete search history.

(56) References Cited

U.S. PATENT DOCUMENTS 3,157,042 A * 11/1964 Wolz ..... E05B 47/0012 292/144
8,419,083 B2 * 4/2013 Burmesch ..... E05B 47/0012 292/144
2008/0246286 A1 * 10/2008 Ostrowski ..... E05B 47/0011 292/144

* cited by examiner

*Primary Examiner* — Mark Williams

(74) *Attorney, Agent, or Firm* — Lucas & Mercanti, LLP

(57) ABSTRACT

Anti-overturn locking system for furniture drawers, with electronic blocking module, where:

the locking system consists of: strip (7), support (6), mobile blocking device (9) and punch (5) which moves linearly guided on a cover (8) on being operated by the blocking module or by an associated punch spring (10); the mobile blocking device (9) may or may not move on the strip (7) according to the position of the punch (5); and the electronic blocking module consists of: tab (2) that can move linearly on casing (1) by the action of a motor (3) that transfers the movement to a cam (4) the shaft of which (4*a*) continuously supports it due to the force exerted by a tab spring (11); and electronic plate (12) equipped with a first sensor (12*a*) and a second sensor (12*b*) on which an arm (2*a*) of the tab (2) is positioned.

7 Claims, 4 Drawing Sheets

ANTI-OVERTURN LOCKING SYSTEM FOR FURNITURE DRAWERS, WITH ELECTRONIC BLOCKING MODULE

CROSS-REFERENCE TO RELATED APPLICATIONS

This application claims the priority of ES P201330189 filed Feb. 13, 2013, which is incorporated by reference herein.

The object of the invention is an anti-overturn locking system, with electronic blocking module.

A preferential application of the system that is the object of the invention is in drawers for office furniture and similar furniture.

In the current state of the art, systems of selective extraction of drawers are already known in office furniture (also called anti-overturn systems or blocking systems) which consist of a strip fixed to the furniture on which plates or separators can slide which carry, for each drawer, a blocking device operated by a bolt associated with the corresponding drawer; so that with one drawer open, the opening of the remaining drawers is prevented.

The known systems are totally mechanical in concept/structure and present various problems, most importantly among which are:

- Use of the physical key, with the resulting nuisance for the user;
- Difficulties in fastening of the strip near the lock (in zones that normally coincide with the zones of reinforcement of the structure of the furniture in which no physical space remains for the mechanical fastening of the strip);
- The size of the lock itself, of its cylinder and of the eccentric shaft required to displace the lock tab.

The system that is the object of the invention solves all these problems. It is characterized in that, with the order of opening/closing of the blocking module by the user given, it consists of:

- a support fastened to the furniture and on which a strip is fastened which serves as a guide for a mobile blocking device which moves until stopping against the support;
- an electronic blocking module which has a tab in a casing equipped with an arm; the tab can move linearly by the action of a motor which transfers the movement to a cam, the shaft of which continuously supports it due to the force exerted by a tab spring; and an electronic plate equipped with a first positioning sensor and a second positioning sensor.
- a guide cover on which a moveable punch is arranged, with protrusions to limit its linear movement on the guide cover and a punch spring which presses the punch against a tab of the electronic blocking module; the punch movement shaft passing slightly below the stop associated with the support so that the outer movement of the tab involves the positioning of the punch blocking the space between the stop associated with the support and the mobile blocking device and the interior movement of the tab involves the unblocking of said space; the arm of the tab being positioned on the first positioning sensor with the tab in exterior movement or on the second positioning sensor with the tab in interior movement.

With the blocking module in closed position, the tab (which has its arm over the first positioning sensor) projects from the casing, pushing the punch until lodging it between the support and the mobile blocking device, preventing its movement, and therefore, the opening of the drawers. This position is reached when the user sends locking information to the blocking module.

With the blocking module in open position, the tab (which has its arm over the second positioning sensor) does not project from the casing liberating the punch, which retracts by the action of the punch spring, allowing the movement of the mobile blocking device, and therefore, the opening of one of the drawers. This position is reached when the user sends opening information to the blocking module.

It is indistinct, and it is included in the object of the invention that the user of the opening/closing order being identified by a RFID device (radio frequency identification), through a code reader, through a biometric reader or through a telephone. The blocking module receives the order through a serial, RF or Ethernet communication bus.

Other configurations and advantages of the invention can be deduced based on the following description, and on the related claims.

To better understand the object of the invention, a preferential form of embodiment is represented in the attached figures, subject to accessory changes that do not essentially alter it. In this case:

Figure 1:
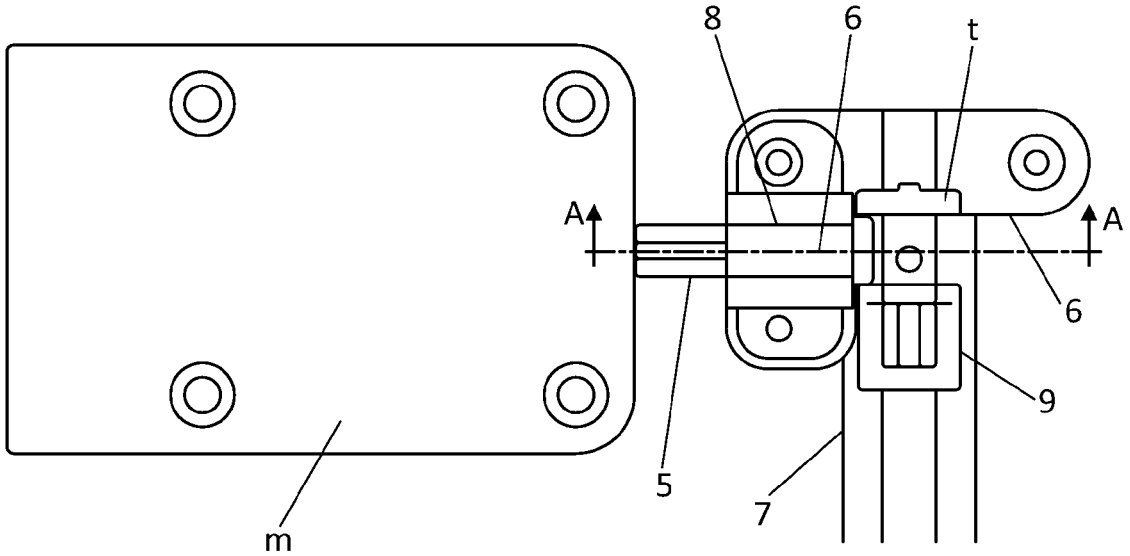
FIG. 1 is a schematic front view of the anti-overturn locking system with electronic blocking module which is the object of the invention in open position.

The following is a description of an example of practical, non-limiting embodiment of this invention. Other ways of embodiment in which accessory changes which do not essentially alter it are introduced are in no way disregarded.

The object of the invention is comprised of an anti-overturn locking system for furniture drawers, with a blocking module which is operated by the user through a method of identification and sends the opening/closing order to said blocking module.

According to the embodiment represented, the main components of the anti-overturn locking system are:

Strip (7).
Support (6).
Punch (5).
Punch cover (8).
Mobile blocking device (9)
Punch spring (10).

According to the embodiment represented, the main components of the blocking module are:

Casing (1).
Tab (2).
Motor (3).
Cam (4).
Tab spring (11).
Electronic plate (12).

The electronic plate (12), in turn, includes:

A first positioning sensor (12*a*); and

A second positioning sensor (12*b*).

The tab (2) can move in one direction by the action of the motor (3)/cam (4) unit and in the opposite direction by the action of the tab spring (11). In turn, in includes an arm (2*a*) which, in these movements, can be placed over the first positioning sensor (12*a*) or over the second positioning sensor (12*b*).

Figure 2:
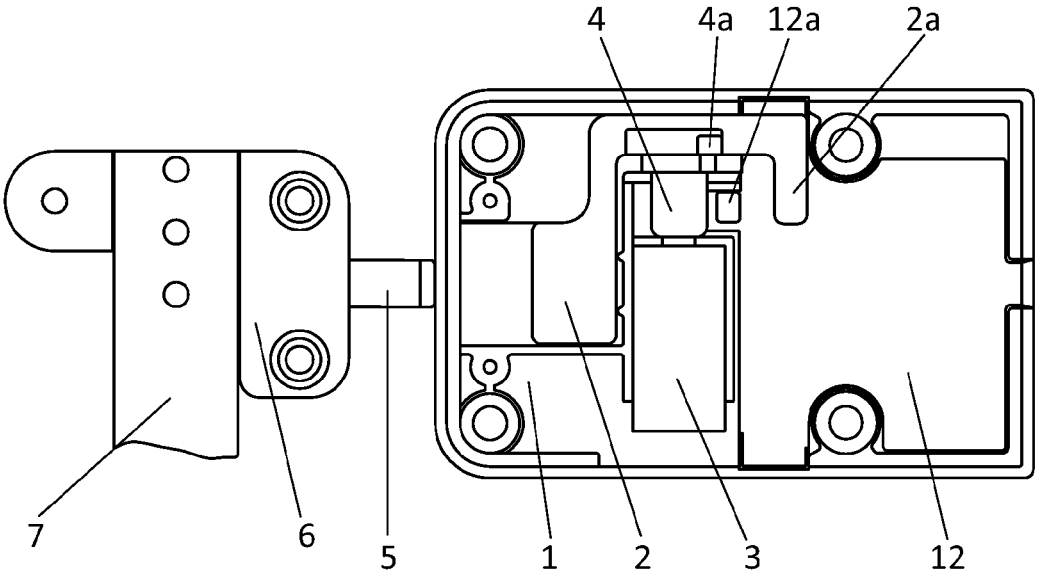
FIG. 2 is a rear schematic view of the anti-overturn locking system with electronic blocking module which is the object of the invention in open position.
Figure 3:
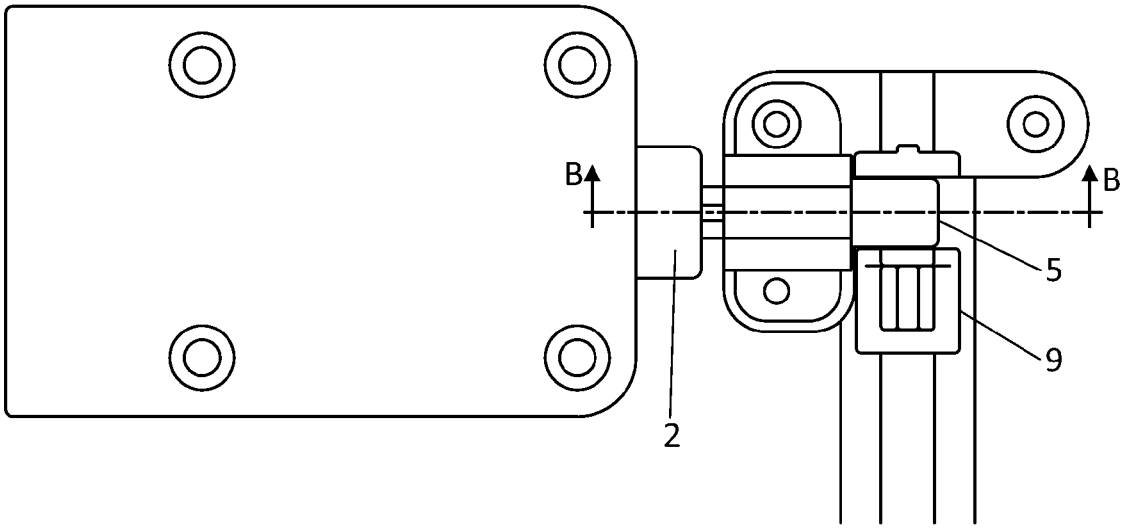
FIG. 3 is a front schematic view similar to FIG. 1, in closed position.
Figure 4:
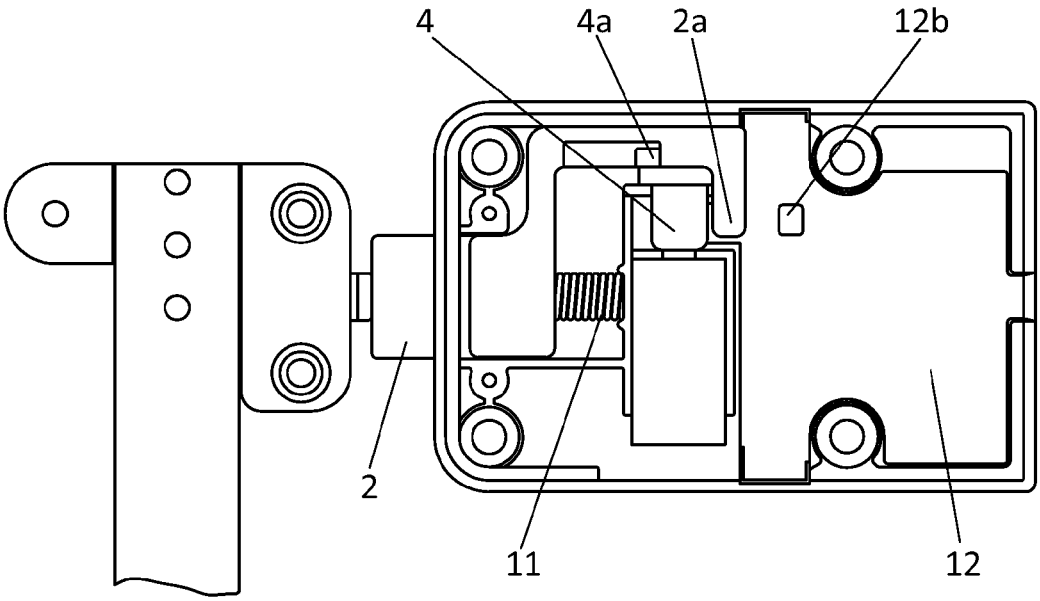
FIG. 4 is a rear schematic view similar to FIG. 2, in closed position.

The arrangement of these main elements that form both the locking system and the blocking module is appreciated in FIGS. 1 and 2, which reproduce these elements in their open operating position and in FIGS. 3 and 4, which reproduce these elements in their closed operating position.

Figure 5:
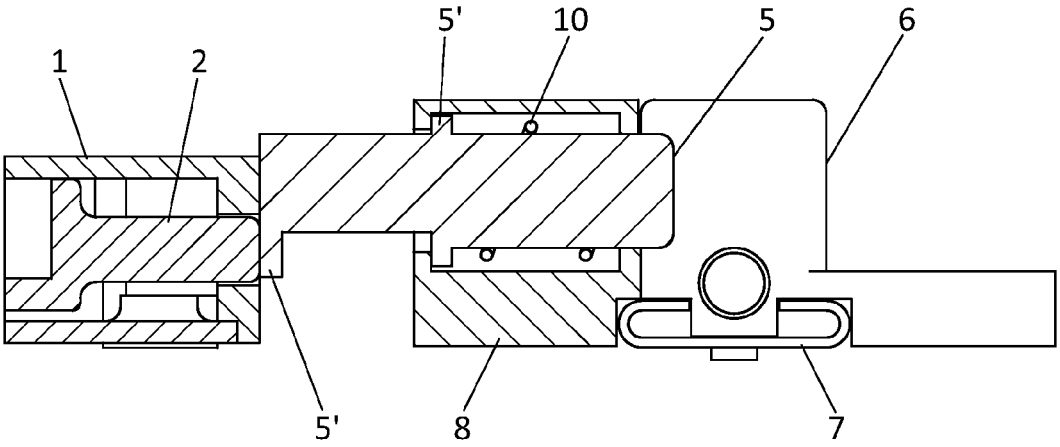
FIG. 5 is an enlarged schematic section, according to indication A:A of FIG. 1.
Figure 6:
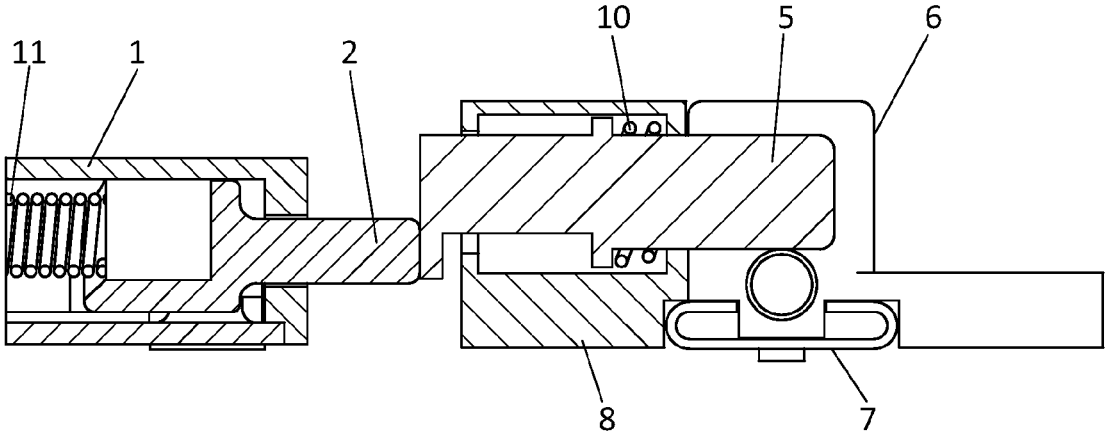
FIG. 6 is an enlarged schematic section, according to indication B:B of FIG. 3.
Figure 7:
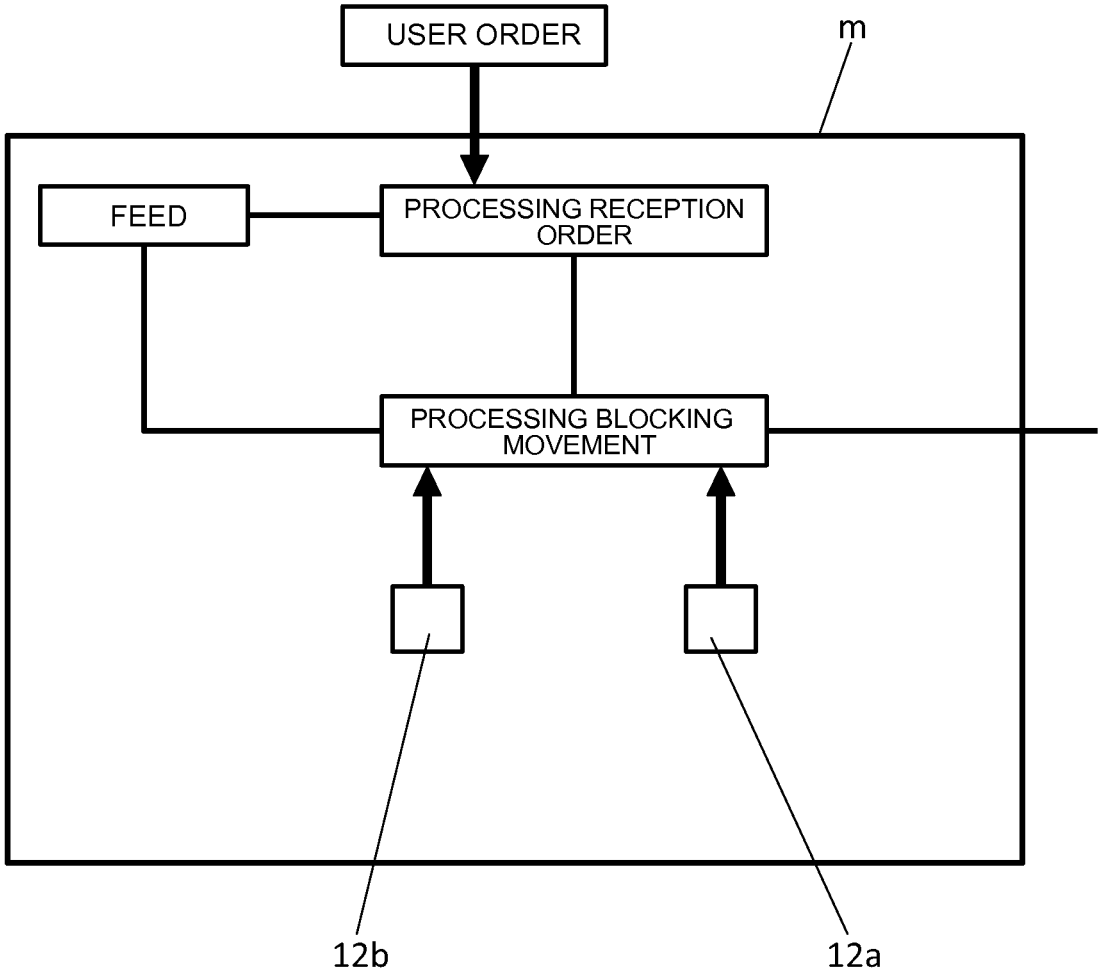
FIG. 7 is a block diagram of the anti-overturn locking system for furniture drawers, which is the object of the invention.

The details of positioning of the punch (5) in these respective positions to allow or to not allow the linear movement of the mobile blocking device (9) have been represented in FIGS. 5 and 6.

With this structuring and particularities, the operation takes place in the following manner:

When the blocking module is in open position (see FIGS. 1, 2 and 5), the tab (2) does not protrude from the casing (1). The arm (2*a*) of the tab (2) is over the second positioning sensor (12*b*).

Once the user is identified, the order is given to lock the blocking module, causing the motor shaft to turn (3). The motor shaft (3) transfers the movement to the cam (4), causing it to turn. The tab (2) is continuously supported on the shaft (4*a*) of the cam (4) due to the force exerted by the tab spring (11). See FIGS. 2 and 4.

The cam (4) turns counter clockwise 180°, causing the tab (2) to slide longitudinally. The turning movement of the motor (3) is transformed into rectilinear movement. The tab (2) pushes the punch (5) of the anti-overturn lock, causing it to enter the hole between the mobile blocking device (9) and the support (6). The punch (5), occupying the hole, prevents the movement of the mobile blocking device (9), thus preventing the opening of the drawers. The tab reaches the final position because the arm of the tab (2*a*) is positioned over the first positioning sensor (12*a*).

When the blocking module is in closed position (see FIGS. 3, 4 and 6), the tab (2) protrudes from the casing (1). The arm (2*a*) of the tab (2) is over the first positioning sensor (12*a*).

Once the user is identified, the opening order is given to the blocking module, causing the shaft of the motor (3) to turn. The shaft of the motor (3) transfers the movement to the cam (4) causing it to turn. The tab (2) is continuously supported on the shaft (4*a*) of the cam (4) due to the force exerted by the tab spring tab (11).

The cam (4) turns counter clockwise 180° causing the tab (2) to slide longitudinally. The turning movement of the motor (3) is transformed into rectilinear movement. When the tab (2) goes back, the punch (5) goes back due to the action of the force of the punch spring (10) leaving free the hole of the anti-overturn lock between the support (6) and the mobile blocking device (9). The tab (2) reaches the final position because the arm of the tab (2*a*) is positioned over the second positioning sensor (12*b*).

In the event that the user opens a drawer, the mobile blocking device (9) is in its highest position; for this reason there is no hold between the mobile blocking device (9) and the support (6) for the punch (5) to enter. If the user at that moment gives the order to close with the transponder card, this causes the shaft of the motor (3) to turn; this shaft causes the cam (4) to turn and it, in turn, causes the tab (2) to turn to its lock position. The tab (2) pushes the punch (5), but it does not enter the hole because it stops against the mobile blocking device (9). In this case the punch (5) waits for the drawer to close in order for the mobile blocking device (9) to descend and to leave the hole free. Once the punch (5) has the hole free, it is automatically inserted due to the action of the force of the punch spring (10) and of the tab spring (11). In this way, the motor (3) does not undergo any type of stress.

Any form used by the user to give the opening/closing is indistinct, and is included in the object of the invention: for example, through a RFID (radio frequency identification) device, through a code reader, through a biometric reader or through communications.

Also indistinct and included in the object of the invention is any way used by the blocking module to receive the order: for example, through a serial communications bus or Ethernet or wireless communication.

The materials, dimensions, proportions and, in general, those other accessory or secondary details that do not essentially alter, change or modify the object proposed may vary.

The terms in which this report is written are a true reflection of the object described, and must be taken in theft broadest sense and never in a limiting manner.

The invention claimed is:

1. Anti-overturn locking system for furniture drawers, comprising:

a) a support connectable to the furniture, a strip fastened to the support, and a mobile blocking device which is guided by the strip and moves along the strip until stopping against a stop of the support;

b) an electronic blocking module having a casing, a tab with an arm, a motor that transfers movement to a cam having a shaft, a tab spring exerting a force on the tab so that the tab it is supported continuously on the shaft of the cam and an electronic plate equipped with a first positioning sensor and a second positioning sensor; and c) a guide cover on which a moveable punch is arranged, the punch having protrusions to limit linear movement of the punch on the guide cover, and a punch spring which presses the punch against the tab of the electronic blocking module; the punch passing slightly below the stop so that an outward movement of the tab positions the punch into the space between the stop and the mobile blocking device, the tab being movable outward to a closed position until the arm of the tab is positioned on the second positioning sensor, and an inward movement of the tab involves unblocking of the space, the tab being movable inward to an open position until the arm of the tab is positioned on the first positioning sensor.

2. Anti-overturn locking system for furniture drawers according to claim 1, wherein, with the tab in closed position, the arm is over the first positioning sensor and the tab protrudes from the casing pushing the punch until the punch lodges between the stop and the mobile blocking device, preventing movement of the mobile blocking device, and therefore, the opening of the drawers, reaching this position when the user gives the closing order to the blocking module.

3. Anti-overturn locking system for furniture drawers according to claim 1, wherein, with the tab in open position, the arm is over the second positioning sensor and the tab does not protrude from the casing, freeing the punch to retract in response to an urgency of the punch spring, thereby allowing the movement of the mobile blocking device, and therefore, the opening of one of the drawers, reaching this position when the user gives the opening order to the blocking module.

4. Anti-overturn locking system for furniture drawers according to claim 1, in which the blocking module is capable of receiving an order from the user through an RFID (radio frequency identification) device.

5. Anti-overturn locking system for furniture drawers according to claim 1, in which the blocking module is capable of receiving an order from the user through a code reader.

6. Anti-overturn locking system for furniture drawers according to claim 1, in which the blocking module is capable of receiving an order from the user gives the order through a biometric reader.

7. Anti-overturn locking system for furniture drawers according to claim 1, in which the blocking module is capable of receiving an order from a user through a serial communication bus, Ethernet or wireless communication.

* * * * *